US012378751B2

(12) United States Patent
Sano et al.

(10) Patent No.: US 12,378,751 B2
(45) Date of Patent: Aug. 5, 2025

(54) SHOVEL

(71) Applicant: SUMITOMO CONSTRUCTION MACHINERY CO., LTD., Tokyo (JP)

(72) Inventors: Kiminori Sano, Chiba (JP); Ryuji Shiratani, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 946 days.

(21) Appl. No.: 17/448,970

(22) Filed: Sep. 27, 2021

(65) Prior Publication Data

US 2022/0010529 A1 Jan. 13, 2022

Related U.S. Application Data

(63) Continuation of application No. PCT/JP2020/014312, filed on Mar. 27, 2020.

(30) Foreign Application Priority Data

Mar. 29, 2019 (JP) ..... 2019-069171

(51) Int. Cl.
*E02F 9/22* (2006.01)

(52) U.S. Cl.
CPC ..... *E02F 9/2292* (2013.01); *E02F 9/2235* (2013.01)

(58) Field of Classification Search
CPC ..... E02F 9/2292; E02F 9/2235
See application file for complete search history.

(56) References Cited

U.S. PATENT DOCUMENTS

| | | | | |
|---|---|---|---|---|
| 9,695,841 | B2 | 7/2017 | Udagawa et al. | |
| 10,273,985 | B2 | 4/2019 | Kondo et al. | |
| 2018/0347598 | A1* | 12/2018 | Kondo | E02F 9/2228 |

FOREIGN PATENT DOCUMENTS

| | | |
|---|---|---|
| EP | 1207304 | 5/2002 |
| EP | 2381114 | 10/2011 |
| EP | 2985471 | 2/2016 |

(Continued)

OTHER PUBLICATIONS

English Machine Translation JP2001241384A (Year: 2001).*
International Search Report for PCT/JP2020/014312 mailed on Jun. 2, 2020.

*Primary Examiner* — Andrew J Cromer
(74) *Attorney, Agent, or Firm* — IPUSA, PLLC

(57) ABSTRACT

A shovel includes a lower traveling structure, an upper swing structure swingably mounted on the lower traveling structure, an engine mounted on the upper swing structure, a first hydraulic pump and a second hydraulic pump each configured to be driven by the engine, a first regulator configured to control the first geometric displacement of the first hydraulic pump, a second regulator configured to control the second geometric displacement of the second hydraulic pump, and processing circuitry configured to electrically control the first and second regulators. Each of the first and second hydraulic pumps is an electrically controlled variable displacement hydraulic pump. The processing circuitry is configured to calculate the limit value of the first and second geometric displacements based on the respective discharge pressures of the first and second hydraulic pumps, and to control each of the first and second geometric displacements based on the calculated limit value.

11 Claims, 4 Drawing Sheets

(56) References Cited

FOREIGN PATENT DOCUMENTS

| | | | | |
|---|---|---|---|---|
| GB | 2171757 | | | 9/1986 |
| GB | 2544447 | | | 5/2017 |
| JP | H10-280490 | | | 10/1998 |
| JP | H11-108181 | | | 4/1999 |
| JP | 2000-104290 | | | 4/2000 |
| JP | 2001-241384 | | | 9/2001 |
| JP | 2001241384 | A | * | 9/2001 |
| JP | 2009-019432 | | | 1/2009 |
| JP | 2010-059738 | | | 3/2010 |
| JP | 2013-185401 | | | 9/2013 |
| JP | 2013-245740 | | | 12/2013 |
| JP | 2016-156393 | | | 9/2016 |
| JP | 2017-020233 | | | 1/2017 |
| JP | 2017-106251 | | | 6/2017 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/014312, filed on Mar. 27, 2020 and designating the U.S., which claims priority to Japanese Patent Application No. 2019-069171, filed on Mar. 29, 2019. The entire contents of the foregoing applications are incorporated herein by reference.

BACKGROUND

Technical Field

The present disclosure relates to shovels serving as excavators.

Description of Related Art

A shovel that includes a first hydraulic pump and a second hydraulic pump that are two variable displacement hydraulic pumps connected to an engine, a first regulator that can change the geometric displacement of the first hydraulic pump, and a second regulator that can change the geometric displacement of the second hydraulic pump has been known.

The geometric displacement of the first hydraulic pump is controlled by the first regulator so that the first hydraulic pump can discharge hydraulic oil commensurate with the amount of operation of an operating lever. The geometric displacement of the second hydraulic pump is controlled by the second regulator so that the second hydraulic pump can discharge hydraulic oil commensurate with the amount of operation of an operating lever. Furthermore, the rotating shaft of each of the first hydraulic pump and the second hydraulic pump is connected to the rotating shaft of the engine. Therefore, the geometric displacements of the first hydraulic pump and the second hydraulic pump are controlled by the first regulator and the second regulator so that the sum of their respective absorbed torques does not exceed the rated torque of the engine.

SUMMARY

According to an embodiment of the present invention, a shovel includes a lower traveling structure, an upper swing structure swingably mounted on the lower traveling structure, an engine mounted on the upper swing structure, a first hydraulic pump configured to be driven by the engine, a second hydraulic pump configured to be driven by the engine, a first regulator configured to control the first geometric displacement of the first hydraulic pump, a second regulator configured to control the second geometric displacement of the second hydraulic pump, and processing circuitry configured to electrically control the first and second regulators. Each of the first and second hydraulic pumps is an electrically controlled variable displacement hydraulic pump. The processing circuitry is configured to calculate the limit value of the first and second geometric displacements based on the respective discharge pressures of the first and second hydraulic pumps, and to control each of the first and second geometric displacements based on the calculated limit value.

DETAILED DESCRIPTION

According to the related-art shovel, each of the first regulator and the second regulator is a hydraulic type. Therefore, the geometric displacement of each of the first hydraulic pump and the second hydraulic pump may not be appropriately controlled.

Thus, it is desired to more appropriately control the geometric displacements of multiple variable displacement hydraulic pumps.

According to an embodiment of the present invention, a shovel that can more appropriately control the geometric displacements of multiple variable displacement hydraulic pumps is provided.

Figure 1:
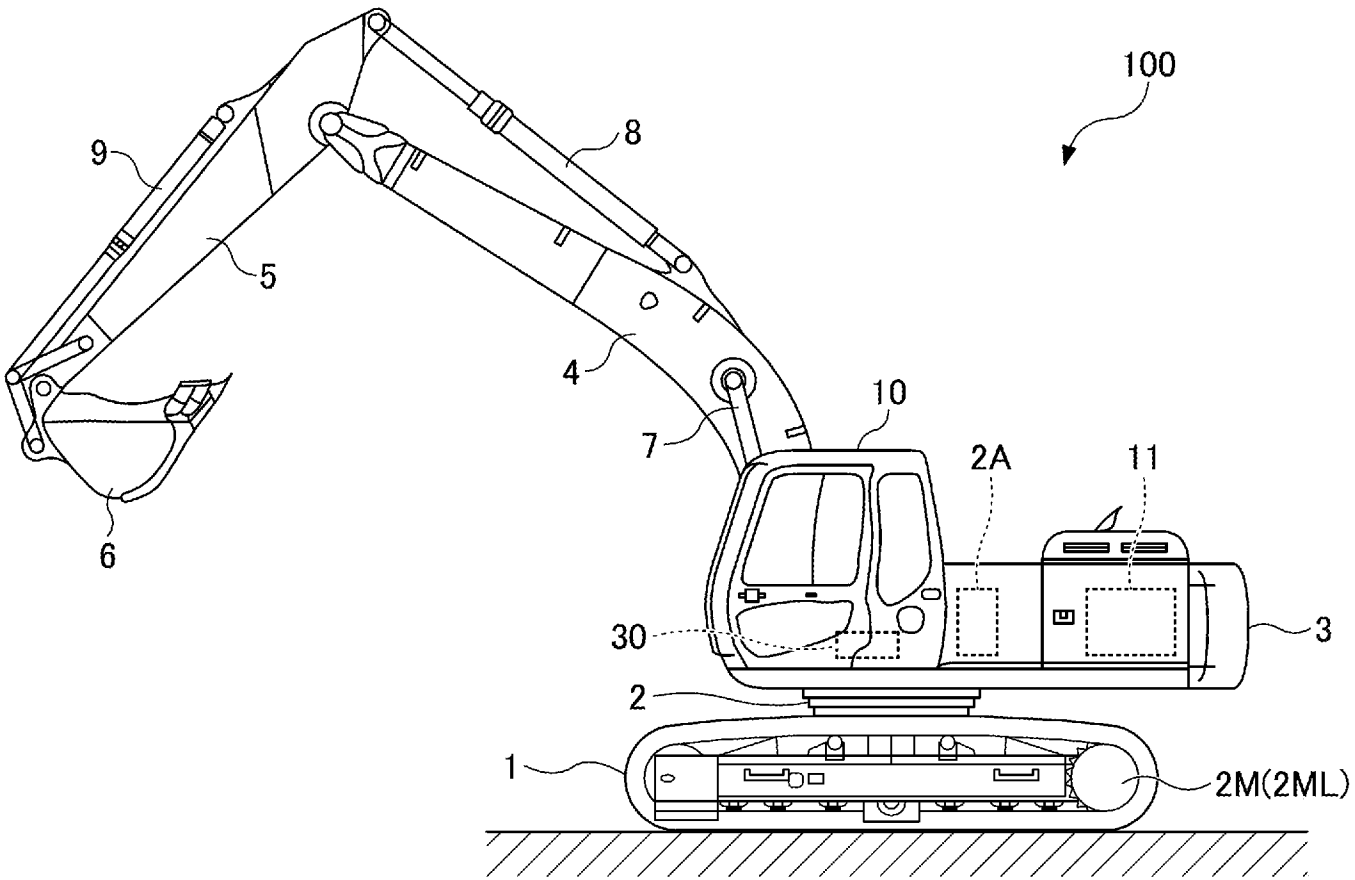
FIG. 1 is a side view of a shovel according to an embodiment of the present invention.

First, a shovel 100 serving as an excavator according to an embodiment of the present invention is described with reference to FIG. 1. FIG. 1 is a side view of the shovel 100. According to this embodiment, an upper swing structure 3 is swingably mounted on a lower traveling structure 1 via a swing mechanism 2. The lower traveling structure 1 is driven by travel hydraulic motors 2M. The travel hydraulic motors 2M include a left travel hydraulic motor 2ML that drives a left crawler and a right travel hydraulic motor 2MR that drives a right crawler (not visible in FIG. 1). The swing mechanism 2 is driven by a swing hydraulic motor 2A mounted on the upper swing structure 3. The swing hydraulic motor 2A, however, may alternatively be a swing motor generator serving as an electric actuator.

A boom 4 is attached to the upper swing structure 3. An arm 5 is attached to the distal end of the boom 4. A bucket 6 serving as an end attachment is attached to the distal end of the arm 5. The boom 4, the arm 5, and the bucket 6 constitute an excavation attachment that is an example of an attachment. The boom 4 is driven by a boom cylinder 7. The arm 5 is driven by an arm cylinder 8. The bucket 6 is driven by a bucket cylinder 9.

A cabin 10 serving as a cab is provided and a power source such as an engine 11 is mounted on the upper swing structure 3. Furthermore, a controller 30 is attached to the upper swing structure 3. In this specification, for convenience, the side of the upper swing structure 3 on which the boom 4 is attached is defined as the front side, and the side of the upper swing structure 3 on which a counterweight is attached is defined as the back side.

The controller 30 (control device) is an example of processing circuitry configured to control the shovel 100. According to this embodiment, the controller 30 is constituted of a computer including a CPU, a volatile storage, and a nonvolatile storage. The controller 30 is so configured as to be able to implement various functions by reading programs corresponding to various functional elements from the nonvolatile storage, loading the programs into the volatile storage such as a RAM, and causing the CPU to execute corresponding processes.

Figure 2:
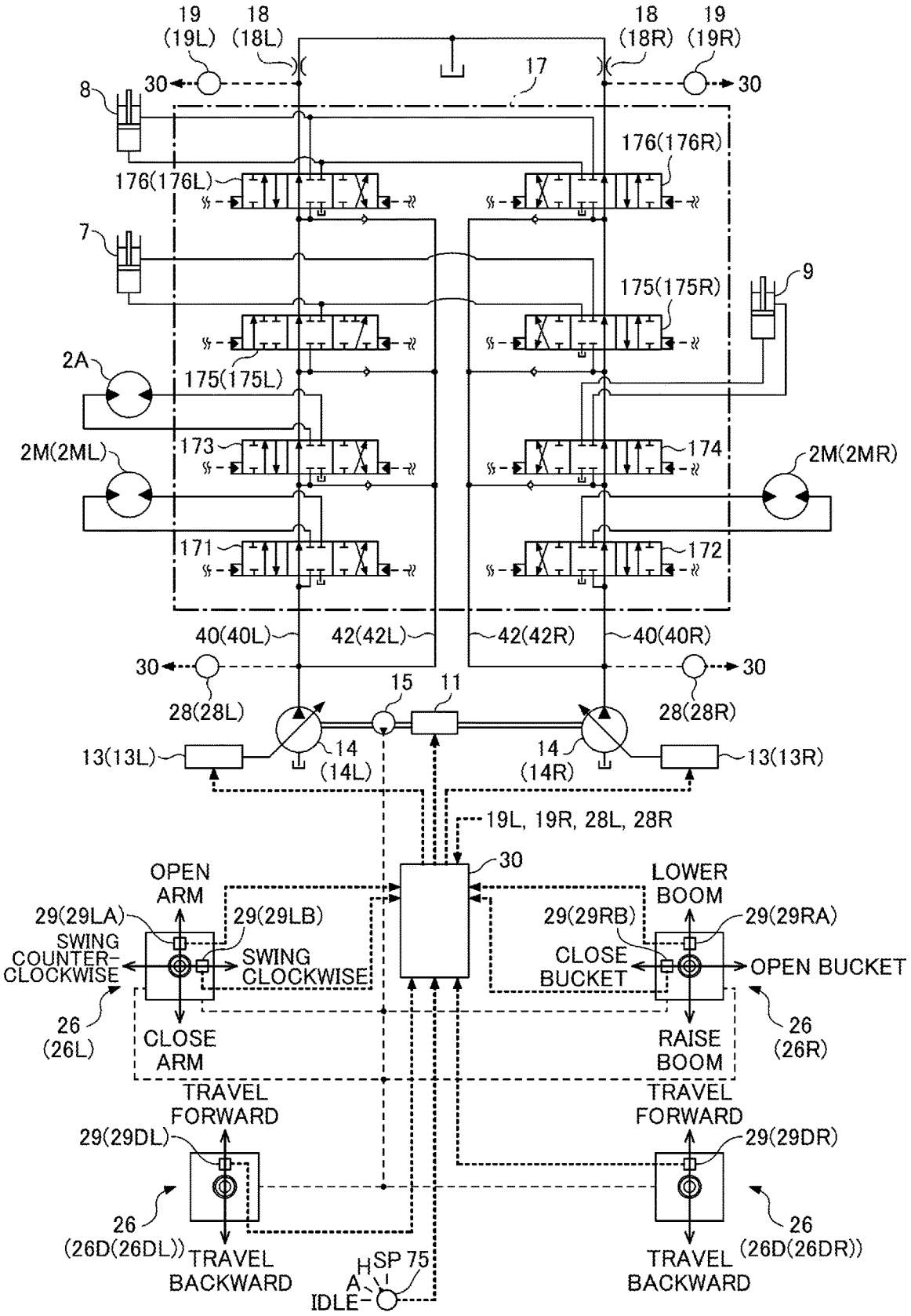
FIG. 2 is a diagram illustrating an example configuration of a hydraulic system installed in the shovel.

Next, an example configuration of a hydraulic system installed in the shovel 100 is described with reference to FIG. 2. FIG. 2 is a diagram illustrating an example configuration of the hydraulic system installed in the shovel 100. In FIG. 2, a mechanical power transmission system, a hydraulic oil line, a pilot line, and an electrical control system are indicated by a double line, a solid line, a dashed line, and a dotted line, respectively.

The hydraulic system of the shovel 100 mainly includes the engine 11, a regulator 13, a main pump 14, a pilot pump 15, a control valve 17, an operating device 26, a discharge pressure sensor 28, an operating pressure sensor 29, the controller 30, and an engine rotational speed adjustment dial 75.

In FIG. 2, the hydraulic system circulates hydraulic oil from the main pump 14 driven by the engine 11 to a hydraulic oil tank via at least one of a center bypass conduit 40 and a parallel conduit 42.

The engine 11 is a power source for the shovel 100. According to this embodiment, the engine 11 is, for example, a diesel engine that operates in such a manner as to maintain a predetermined rotational speed. The output shaft of the engine 11 is connected to the input shaft of each of the main pump 14 and the pilot pump 15.

Furthermore, the engine 11 includes a supercharger. According to this embodiment, the supercharger is a turbocharger that uses exhaust gas. The engine 11 is controlled by an engine control unit. The engine control unit is configured to, for example, control the amount of fuel injection according to supercharging pressure (boost pressure). The boost pressure is, for example, detected by a boost pressure sensor.

The main pump 14 is configured to supply hydraulic oil to the control valve 17 via a hydraulic oil line. According to this embodiment, the main pump 14 is an electrically controlled hydraulic pump. Specifically, the main pump 14 is a swash plate variable displacement hydraulic pump.

The regulator 13 controls the geometric displacement of the main pump 14. According to this embodiment, the regulator 13 controls the discharge quantity of the main pump 14 by controlling the geometric displacement per revolution of the main pump 14 by adjusting the swash plate tilt angle of the main pump 14 in response to a command value from the controller 30.

The pilot pump 15 is configured to supply hydraulic oil to hydraulic control devices including the operating device 26 via a pilot line. According to this embodiment, the pilot pump 15 is a fixed displacement hydraulic pump. The pilot pump 15 may be omitted. In this case, the function carried by the pilot pump 15 may be implemented by the main pump 14. That is, the main pump 14 may have the function of supplying hydraulic oil to the operating device 26, etc., after reducing the pressure of the hydraulic oil with a throttle or the like, apart from the function of supplying hydraulic oil to the control valve 17.

The control valve 17 is a hydraulic controller that controls the hydraulic system in the shovel 100. According to this embodiment, the control valve 17 includes control valves 171 through 176 as indicated by a one-dot chain line. The control valve 175 includes a control valve 175L and a control valve 175R. The control valve 176 includes a control valve 176L and a control valve 176R. The control valve 17 can selectively supply hydraulic oil discharged by the main pump 14 to one or more hydraulic actuators through the control valves 171 through 176. The control valves 171 through 176 control the flow rate of hydraulic oil flowing from the main pump 14 to the hydraulic actuators and the flow rate of hydraulic oil flowing from the hydraulic actuators to the hydraulic oil tank. The hydraulic actuators include the boom cylinder 7, the arm cylinder 8, the bucket cylinder 9, the left travel hydraulic motor 2ML, the right travel hydraulic motor 2MR, and the swing hydraulic motor 2A.

The operating device 26 is a device that the operator uses to operate actuators. The actuators include at least one of a hydraulic actuator and an electric actuator. According to this embodiment, the operating device 26 is configured to supply hydraulic oil discharged by the pilot pump 15 to a pilot port of a corresponding control valve in the control valve 17 via a pilot line. A pilot pressure, which is the pressure of hydraulic oil supplied to each pilot port, is a pressure commensurate with the direction of operation and the amount of operation of a lever or a pedal (not depicted) of the operating device 26 corresponding to each hydraulic actuator.

The discharge pressure sensor 28 is configured to detect the discharge pressure of the main pump 14. According to this embodiment, the discharge pressure sensor 28 outputs a detected value to the controller 30.

The operating pressure sensor 29 is configured to detect the details of an operation through the operating device 26. According to this embodiment, the operating pressure sensor 29 detects the direction of operation and the amount of operation of a lever or a pedal serving as the operating device 26 corresponding to each actuator in the form of pressure (operating pressure), and outputs the detected value to the controller 30. The operation details of the operating device 26 may also be detected using a sensor other than an operating pressure sensor.

The main pump 14 includes a left main pump 14L and a right main pump 14R. The left main pump 14L circulates hydraulic oil to the hydraulic oil tank via a left center bypass conduit 40L or a left parallel conduit 42L. The right main pump 14R circulates hydraulic oil to the hydraulic oil tank via a right center bypass conduit 40R or a right parallel conduit 42R.

The left center bypass conduit 40L is a hydraulic oil line that passes through the control valves 171, 173, 175L, and 176L placed in the control valve 17. The right center bypass conduit 40R is a hydraulic oil line that passes through the control valves 172, 174, 175R, and 176R placed in the control valve 17.

The control valve 171 is a spool valve that switches the flow of hydraulic oil to supply hydraulic oil discharged by the left main pump 14L to the left travel hydraulic motor 2ML and to discharge hydraulic oil discharged by the left travel hydraulic motor 2ML to the hydraulic oil tank.

The control valve 172 is a spool valve that switches the flow of hydraulic oil to supply hydraulic oil discharged by the right main pump 14R to the right travel hydraulic motor 2MR and to discharge hydraulic oil discharged by the right travel hydraulic motor 2MR to the hydraulic oil tank.

The control valve 173 is a spool valve that switches the flow of hydraulic oil to supply hydraulic oil discharged by the left main pump 14L to the swing hydraulic motor 2A and to discharge hydraulic oil discharged by the swing hydraulic motor 2A to the hydraulic oil tank.

The control valve 174 is a spool valve that switches the flow of hydraulic oil to supply hydraulic oil discharged by the right main pump 14R to the bucket cylinder 9 and to discharge hydraulic oil in the bucket cylinder 9 to the hydraulic oil tank.

The control valve 175L is a spool valve that switches the flow of hydraulic oil to supply hydraulic oil discharged by the left main pump 14L to the boom cylinder 7. The control valve 175R is a spool valve that switches the flow of hydraulic oil to supply hydraulic oil discharged by the right main pump 14R to the boom cylinder 7 and to discharge hydraulic oil in the boom cylinder 7 to the hydraulic oil tank. When a required flow rate to the boom cylinder 7 is low, hydraulic oil is supplied from one of the control valve 175L and the control valve 175R to the boom cylinder 7. When the required flow rate is high, hydraulic oil is supplied from both of the control valve 175L and the control valve 175R to the boom cylinder 7. A flow rate required of each pump is calculated pump by pump.

The control valve 176L is a spool valve that switches the flow of hydraulic oil to supply hydraulic oil discharged by the left main pump 14L to the arm cylinder 8 and to discharge hydraulic oil in the arm cylinder 8 to the hydraulic oil tank. The control valve 176R is a spool valve that switches the flow of hydraulic oil to supply hydraulic oil discharged by the right main pump 14R to the arm cylinder 8 and to discharge hydraulic oil in the arm cylinder 8 to the hydraulic oil tank. When a required flow rate to the arm cylinder 8 is low, hydraulic oil is supplied from one of the control valve 176L and the control valve 176R to the arm cylinder 8. When the required flow rate is high, hydraulic oil is supplied from both of the control valve 176L and the control valve 176R to the arm cylinder 8. A flow rate required of each pump is calculated pump by pump.

The left parallel conduit 42L is a hydraulic oil line running parallel to the left center bypass conduit 40L. When the flow of hydraulic oil through the left center bypass conduit 40L is restricted or blocked by any of the control valves 171, 173 and 175L, the left parallel conduit 42L can supply hydraulic oil to a control valve further downstream. The right parallel conduit 42R is a hydraulic oil line running parallel to the right center bypass conduit 40R. When the flow of hydraulic oil through the right center bypass conduit 40R is restricted or blocked by any of the control valves 172, 174 and 175R, the right parallel conduit 42R can supply hydraulic oil to a control valve further downstream.

The regulator 13 includes a left regulator 13L and a right regulator 13R. The left regulator 13L is configured to control the geometric displacement of the left main pump 14L by adjusting the swash plate tilt angle of the left main pump 14L in accordance with the discharge pressure of the left main pump 14L. This control is referred to as power control or horsepower control. Specifically, the left regulator 13L, for example, reduces the discharge quantity of the left main pump 14L by reducing its geometric displacement per revolution by adjusting its swash plate tilt angle, according as the discharge pressure of the left main pump 14L increases. The same is the case with the right regulator 13R. This is for preventing the absorbed power (absorbed horsepower) of the main pump 14, expressed as the product of discharge pressure and discharge quantity, from exceeding the output power (output horsepower) of the engine 11.

The operating device 26 includes a left operating lever 26L, a right operating lever 26R, and travel levers 26D. The travel levers 26D include a left travel lever 26DL and a right travel lever 26DR.

The left operating lever 26L is used for swing operation and for operating the arm 5. The left operating lever 26L is operated forward or backward to cause a pilot pressure commensurate with the amount of lever operation to be introduced into a pilot port of the control valve 176, using hydraulic oil discharged by the pilot pump 15. The left operating lever 26L is operated rightward or leftward to cause a pilot pressure commensurate with the amount of lever operation to be introduced into a pilot port of the control valve 173, using hydraulic oil discharged by the pilot pump 15.

Specifically, the left operating lever 26L is operated in an arm closing direction to cause hydraulic oil to be introduced into the right pilot port of the control valve 176L and cause hydraulic oil to be introduced into the left pilot port of the control valve 176R. Furthermore, the left operating lever 26L is operated in an arm opening direction to cause hydraulic oil to be introduced into the left pilot port of the control valve 176L and cause hydraulic oil to be introduced into the right pilot port of the control valve 176R. Furthermore, the left operating lever 26L is operated in a counterclockwise swing direction to cause hydraulic oil to be introduced into the left pilot port of the control valve 173, and is operated in a clockwise swing direction to cause hydraulic oil to be introduced into the right pilot port of the control valve 173.

The right operating lever 26R is used to operate the boom 4 and operate the bucket 6. The right operating lever 26R is operated forward or backward to cause a pilot pressure commensurate with the amount of lever operation to be introduced into a pilot port of the control valve 175, using hydraulic oil discharged by the pilot pump 15. The right operating lever 26R is operated rightward or leftward to cause a pilot pressure commensurate with the amount of lever operation to be introduced into a pilot port of the control valve 174, using hydraulic oil discharged by the pilot pump 15.

Specifically, the right operating lever 26R is operated in a boom lowering direction to cause hydraulic oil to be introduced into the right pilot port of the control valve 175R. Furthermore, the right operating lever 26R is operated in a boom raising direction to cause hydraulic oil to be introduced into the right pilot port of the control valve 175L and cause hydraulic oil to be introduced into the left pilot port of the control valve 175R. The right operating lever 26R is operated in a bucket closing direction to cause hydraulic oil to be introduced into the left pilot port of the control valve 174, and is operated in a bucket opening direction to cause hydraulic oil to be introduced into the right pilot port of the control valve 174.

The travel levers 26D are used to operate the crawlers. Specifically, the left travel lever 26DL is used to operate the left crawler. The left travel lever 26DL may be configured to operate together with a left travel pedal. The left travel lever 26DL is operated forward or backward to cause a pilot pressure commensurate with the amount of lever operation to be introduced into a pilot port of the control valve 171, using hydraulic oil discharged by the pilot pump 15. The right travel lever 26DR is used to operate the right crawler. The right travel lever 26DR may be configured to operate together with a right travel pedal. The right travel lever 26DR is operated forward or backward to cause a pilot pressure commensurate with the amount of lever operation to be introduced into a pilot port of the control valve 172, using hydraulic oil discharged by the pilot pump 15.

The discharge pressure sensor 28 includes a left discharge pressure sensor 28L and a right discharge pressure sensor 28R. The left discharge pressure sensor 28L detects the discharge pressure of the left main pump 14L, and outputs the detected value to the controller 30. The same is the case with the right discharge pressure sensor 28R.

The operating pressure sensor 29 includes operating pressure sensors 29LA, 29LB, 29RA, 29RB, 29DL and 29DR. The operating pressure sensor 29LA detects the details of a forward or backward operation on the left operating lever 26L in the form of pressure, and outputs the detected value to the controller 30. Examples of the details of operation include the direction of lever operation and the amount of lever operation (the angle of lever operation).

Likewise, the operating pressure sensor 29LB detects the details of a rightward or leftward operation on the left operating lever 26L in the form of pressure, and outputs the detected value to the controller 30. The operating pressure sensor 29RA detects the details of a forward or backward operation on the right operating lever 26R in the form of pressure, and outputs the detected value to the controller 30. The operating pressure sensor 29RB detects the details of a rightward or leftward operation on the right operating lever 26R in the form of pressure, and outputs the detected value to the controller 30. The operating pressure sensor 29DL detects the details of a forward or backward operation on the left travel lever 26DL in the form of pressure, and outputs the detected value to the controller 30. The operating pressure sensor 29DR detects the details of a forward or backward operation on the right travel lever 26DR in the form of pressure, and outputs the detected value to the controller 30.

The controller 30 may receive the output of the operating pressure sensor 29, and output a control command to the regulator 13 to change the geometric displacement of the main pump 14 on an as-needed basis.

Furthermore, the controller 30 is configured to perform negative control as energy saving control using a throttle 18 and a control pressure sensor 19. The throttle 18 includes a left throttle 18L and a right throttle 18R and the control pressure sensor 19 includes a left control pressure sensor 19L and a right control pressure sensor 19R. According to this embodiment, the control pressure sensor 19 operates as a negative control pressure sensor. The energy saving control is control to reduce the geometric displacement of the main pump 14 in order to prevent the main pump 14 from wasting energy.

The left throttle 18L is placed between the most downstream control valve 176L and the hydraulic oil tank in the left center bypass conduit 40L. Therefore, the flow of hydraulic oil discharged by the left main pump 14L is restricted by the left throttle 18L. The left throttle 18L generates a control pressure (a negative control pressure) for controlling the left regulator 13L. The left control pressure sensor 19L is a sensor for detecting this control pressure, and outputs a detected value to the controller 30. The controller 30 controls the geometric displacement of the left main pump 14L according to the negative control by adjusting the swash plate tilt angle of the left main pump 14L in accordance with this control pressure. The controller 30 decreases the geometric displacement of the left main pump 14L as this control pressure increases, and increases the geometric displacement of the left main pump 14L as this control pressure decreases. The geometric displacement of the right main pump 14R is controlled in the same manner.

Specifically, when no hydraulic actuators in the shovel 100 are operated, that is, the shovel 100 is in a standby state as illustrated in FIG. 2, hydraulic oil discharged by the left main pump 14L arrives at the left throttle 18L through the left center bypass conduit 40L. The flow of hydraulic oil discharged by the left main pump 14L increases the control pressure generated upstream of the left throttle 18L. As a result, the controller 30 decreases the discharge quantity of the left main pump 14L to a standby flow rate to reduce pressure loss (pumping loss) during the passage of the discharged hydraulic oil through the left center bypass conduit 40L. The standby flow rate is a predetermined flow rate that is employed in the standby state, and is, for example, a minimum allowable discharge quantity. In contrast, when any of the hydraulic actuators is operated, hydraulic oil discharged by the left main pump 14L flows into the operated hydraulic actuator via a control valve corresponding to the operated hydraulic actuator. The control valve corresponding to the operated hydraulic actuator causes the flow rate of hydraulic oil arriving at the left throttle 18L to decrease or become zero to reduce the control pressure generated upstream of the left throttle 18L. As a result, the controller 30 increases the discharge quantity of the left main pump 14L to circulate sufficient hydraulic oil to the operated hydraulic actuator to ensure driving of the operated hydraulic actuator. The controller 30 controls the geometric displacement of the right main pump 14R in the same manner.

According to the negative control as described above, the hydraulic system of FIG. 2 can control unnecessary energy consumption in the main pump 14 in the standby state. The unnecessary energy consumption includes pumping loss that hydraulic oil discharged by the main pump 14 causes in the center bypass conduit 40. Furthermore, in the case of actuating a hydraulic actuator, the hydraulic system of FIG. 2 can ensure that necessary and sufficient hydraulic oil is supplied from the main pump 14 to the hydraulic actuator to be actuated.

The engine rotational speed adjustment dial 75 is a dial for adjusting the rotational speed of the engine 11. The engine rotational speed adjustment dial 75 transmits data indicating the setting of the engine rotational speed to the controller 30. According to this embodiment, the engine rotational speed adjustment dial 75 is configured to allow the engine rotational speed to be selected from the four levels of SP mode, H mode, A mode, and IDLE mode. The SP mode is a rotational speed mode selected when it is desired to prioritize workload, and uses the highest engine rotational speed. The H mode is a rotational speed mode selected when it is desired to satisfy both workload and fuel efficiency, and uses the second highest engine rotational speed. The A mode is a rotational speed mode selected when it is desired to operate the shovel 100 with low noise while prioritizing fuel efficiency, and uses the third highest engine rotational speed. The IDLE mode is a rotational speed mode selected when it is desired to idle the engine 11, and uses the lowest engine rotational speed. The engine 11 is controlled to constantly rotate at the engine rotational speed of a rotational speed mode set by the engine rotational speed adjustment dial 75.

Next, a first setting process that is an example of the process of the controller 30 setting the geometric displacement of the main pump 14 (hereinafter "setting process") is described. For example, the controller 30 repeatedly executes this first setting process at predetermined control intervals while the engine 11 is in operation.

First, the controller 30 obtains a target torque T of the engine 11, a discharge pressure P1 of the left main pump 14L, and a discharge pressure P2 of the right main pump 14R. The target torque T of the engine 11 is, for example, a predetermined torque that the engine 11 can output. According to this embodiment, the controller 30 obtains the target torque T based on the output information of the engine rotational speed adjustment dial 75, obtains the discharge pressure P1 based on the output information of the left discharge pressure sensor 28L, and obtains the discharge pressure P2 based on the output information of the right discharge pressure sensor 28R.

Thereafter, the controller 30 calculates a maximum allowable geometric displacement $Q_{limit}$ corresponding to the discharge pressures P1 and P2 with respect to the target torque T of the engine 11. According to this embodiment, the controller 30 calculates the maximum allowable geometric displacement $Q_{limit}$, using Eq. (1):

$$Q_{limit} = \frac{2 \times \pi \times T}{P1 + P2} \quad (1)$$

The maximum allowable geometric displacement $Q_{limit}$ is a maximum geometric displacement that may be set to the extent that a total absorbed torque, which is the sum of the absorbed torque of the left main pump 14L and the absorbed torque of the right main pump 14R, does not exceed the target torque T of the engine 11. When a geometric displacement Q1 of the left main pump 14L or a geometric displacement Q2 of the right main pump 14R exceeds the maximum allowable geometric displacement $Q_{limit}$, the total absorbed torque of the main pump 14 may exceed the target torque T of the engine 11, so that the rotational speed of the engine 11 may decrease. Therefore, the controller 30 executes the following process to prevent the geometric displacement Q1 and the geometric displacement Q2 from exceeding the maximum allowable geometric displacement $Q_{limit}$.

Specifically, the controller 30 calculates a required geometric displacement Q1* of the left main pump 14L and a required geometric displacement Q2* of the right main pump 14R. The required geometric displacement Q1* denotes the ideal geometric displacement of the left main pump 14L corresponding to the operation details of the operating device 26, namely, the ideal geometric displacement of the left main pump 14L when restrictions imposed by the target torque T of the engine 11, etc., are not considered. The same applies to the required geometric displacement Q2*.

According to this embodiment, the controller 30 calculates the required geometric displacement Q1* based on the output information of the left control pressure sensor 19L and calculates the required geometric displacement Q2* based on the output information of the right control pressure sensor 19R. In calculating the required geometric displacement Q1* and the required geometric displacement Q2*, the controller 30 may use the output information of the operating device 26. The controller 30 may calculate the required geometric displacement Q1* and the required geometric displacement Q2* before calculating the maximum allowable geometric displacement $Q_{limit}$.

Thereafter, the controller 30 determines whether the required geometric displacement Q1* of the left main pump 14L is greater than or equal to the maximum allowable geometric displacement $Q_{limit}$.

In response to determining that the required geometric displacement Q1* is greater than or equal to the maximum allowable geometric displacement $Q_{limit}$, the controller 30 sets the required geometric displacement Q1* to the maximum allowable geometric displacement $Q_{limit}$. This is for preventing the actual geometric displacement Q1 of the left main pump 14L from exceeding the maximum allowable geometric displacement $Q_{limit}$.

Furthermore, the controller 30 determines whether the required geometric displacement Q2* of the right main pump 14R is greater than or equal to the maximum allowable geometric displacement $Q_{limit}$.

In response to determining that the required geometric displacement Q2* is greater than or equal to the maximum allowable geometric displacement $Q_{limit}$, the controller 30 sets the required geometric displacement Q2* to the maximum allowable geometric displacement $Q_{limit}$. This is for preventing the actual geometric displacement Q2 of the right main pump 14R from exceeding the maximum allowable geometric displacement $Q_{limit}$.

Thereafter, the controller 30 outputs a command value based on the required geometric displacement Q1* to the left regulator 13L and outputs a command value based on the required geometric displacement Q2* to the right regulator 13R.

By preventing the geometric displacement Q1 of the left main pump 14L and the geometric displacement Q2 of the right main pump 14R from exceeding the maximum allowable geometric displacement $Q_{limit}$ according to this first setting process, the controller 30 can prevent a decrease in the rotational speed of the engine 11 due to the total absorbed torque of the main pump 14 exceeding the target torque T of the engine 11. For example, even when the discharge pressure of at least one of the left main pump 14L and the right main pump 14R abruptly increases to abruptly increase the absorbed torque of the at least one of the left main pump 14L and the right main pump 14R, the controller 30 can prevent the total absorbed torque of the main pump 14 from exceeding the target torque T of the engine 11.

Next, a specific example of the geometric displacement of the main pump 14 set by the above-described first setting process is described. Specifically, values related to the geometric displacement of the main pump 14 that are set when a complex operation of a boom raising operation and an arm closing operation is performed are described. More specifically, values related to the geometric displacement of the main pump 14 that are set when the operation of quickly closing the arm 5 with hydraulic oil discharged by the left main pump 14L while slowing raising the boom 4 with hydraulic oil discharged by the right main pump 14R is performed are described.

The values related to the geometric displacement of the main pump 14 include the required geometric displacement Q1* of the left main pump 14L, the required geometric displacement Q2* of the right main pump 14R, the maximum allowable geometric displacement $Q_{limit}$, and a maximum geometric displacement $Q_{max}$. The maximum allowable geometric displacement $Q_{limit}$ and the maximum geometric displacement $Q_{max}$ are values common to the left main pump 14L and the right main pump 14R. The maximum geometric displacement $Q_{max}$ is the maximum value of the geometric displacement determined by the mechanical restriction of the main pump 14.

The controller 30, for example, obtains 577 [N·m] as the target torque T, obtains 20 [MPa] as the discharge pressure P1 of the left main pump 14L, and obtains 20 [MPa] as the discharge pressure P2 of the right main pump 14R. Then, the controller 30 calculates the maximum allowable geometric displacement $Q_{limit}$ at 90 [cc/rev], using Eq. (1). Furthermore, the controller 30 calculates the required geometric displacement Q1* of the left main pump 14L for extending the arm cylinder 8 at 110 [cc/rev] based on the output of the left control pressure sensor 19L and calculates the required geometric displacement Q2* of the right main pump 14R for extending the boom cylinder 7 at 20 [cc/rev] based on the output of the right control pressure sensor 19R.

In this case, the controller 30 determines that the required geometric displacement Q1* (=110 [cc/rev]) is greater than or equal to the maximum allowable geometric displacement $Q_{limit}$ (=90 [cc/rev]), and sets the required geometric displacement Q1* to the maximum allowable geometric displacement $Q_{limit}$. That is, the controller 30 reduces the value of the required geometric displacement Q1* from 110 [cc/rev] to 90 [cc/rev] by 20 [cc/rev].

On the other hand, the controller 30 determines that the required geometric displacement Q2* (=20 [cc/rev]) is less than the maximum allowable geometric displacement $Q_{limit}$ (=90 [cc/rev]), and does not change and keeps the value of the required geometric displacement Q2* (=20 [cc/rev]).

Thereafter, the controller 30 outputs a command value based on the required geometric displacement Q1* (=90 [cc/rev]) to the left regulator 13L and outputs a command value based on the required geometric displacement Q2* (=20 [cc/rev]) to the right regulator 13R.

As a result, the controller 30 can cause the left main pump 14L to discharge hydraulic oil with the geometric displacement Q1 (=90 [cc/rev]) lower than the initial required geometric displacement Q1* (=110 [cc/rev]) to extend the arm cylinder 8 to quickly close the arm 5.

Furthermore, the controller 30 can cause the right main pump 14R to discharge hydraulic oil with the same geometric displacement Q2 (=20 [cc/rev]) as the initial required geometric displacement Q2* (=20 [cc/rev]) to extend the boom cylinder 7 to slowly raise the boom 4.

Thus, according to the first setting process, the controller 30 calculates the appropriate maximum allowable geometric displacement $Q_{limit}$ corresponding to the discharge pressures P1 and P2 with respect to the target torque T of the engine 11. Accordingly, the controller 30 can appropriately calculate the maximum allowable geometric displacement $Q_{limit}$ according to the output of the engine 11 and a load. Therefore, it is possible to reduce an overload on the engine 11.

Figure 3:
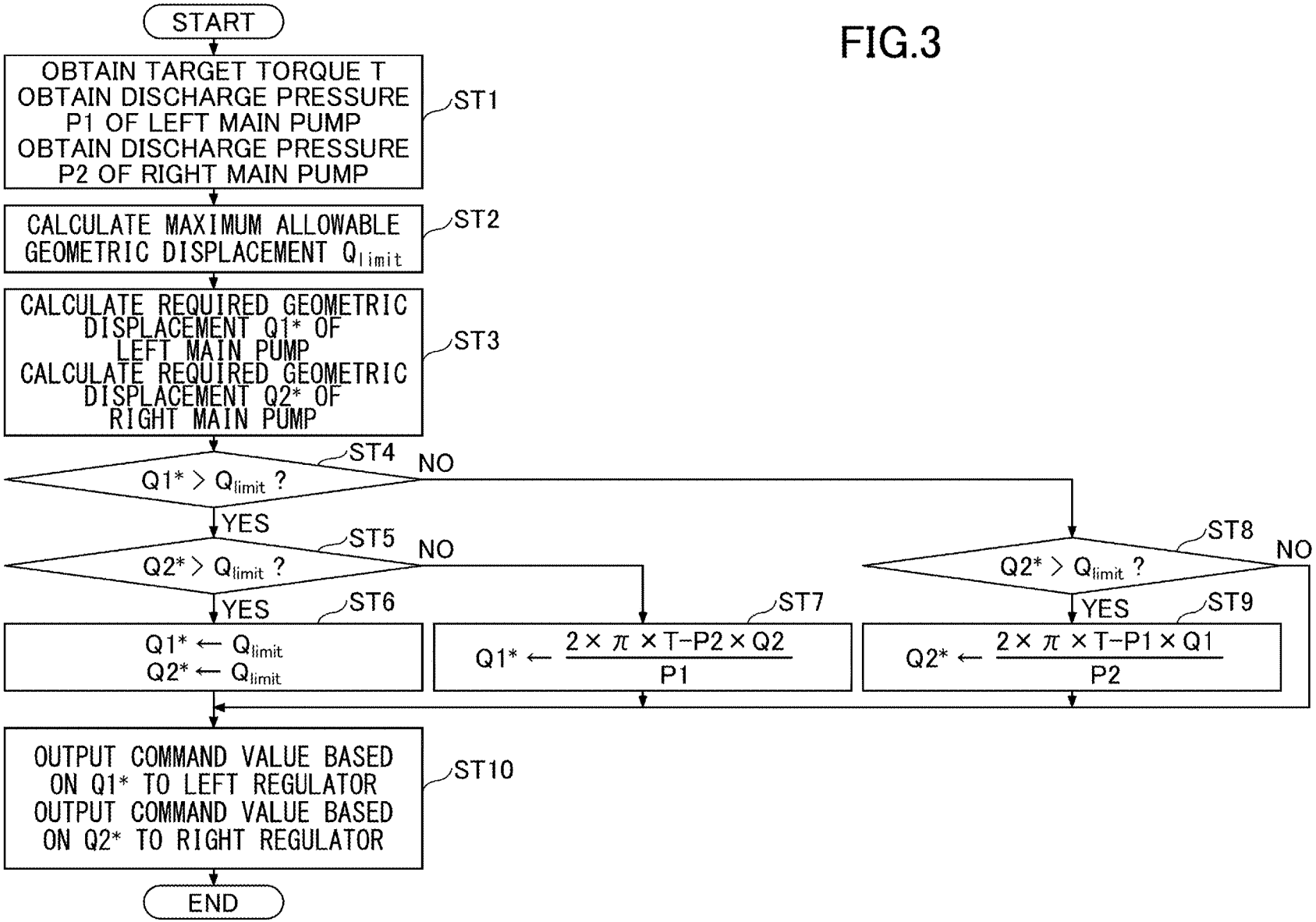
FIG. 3 is a flowchart of another example of a setting process.

Next, a second setting process that is another example of the setting process is described with reference to FIG. 3. FIG. 3 is a flowchart illustrating a flow of the setting process. The controller 30, for example, repeatedly executes this second setting process at predetermined control intervals while the engine 11 is in operation.

First, the controller 30 obtains the target torque T of the engine 11, the discharge pressure P1 of the left main pump 14L, and the discharge pressure P2 of the right main pump 14R (step ST1). According to this embodiment, the controller 30 obtains the target torque T based on the output information of the engine rotational speed adjustment dial 75, obtains the discharge pressure P1 based on the output information of the left discharge pressure sensor 28L, and obtains the discharge pressure P2 based on the output information of the right discharge pressure sensor 28R.

Thereafter, the controller 30 calculates the maximum allowable geometric displacement $Q_{limit}$ (step ST2). According to this embodiment, the controller 30 uses Eq. (1) to calculate the maximum allowable geometric displacement $Q_{limit}$.

Thereafter, the controller 30 calculates the required geometric displacement Q1* of the left main pump 14L and the required geometric displacement Q2* of the right main pump 14R (step ST3).

Thereafter, the controller 30 determines whether the required geometric displacement Q1* of the left main pump 14L is greater than the maximum allowable geometric displacement $Q_{limit}$ (step ST4). That is, the controller 30 determines whether a torque allocated to the left main pump 14L as a torque available to the left main pump 14L (hereinafter, "left available torque") is excessive or insufficient relative to an absorbed torque necessary for achieving the required geometric displacement Q1* of the left main pump 14L. Then, in response to determining that the required geometric displacement Q1* is greater than the maximum allowable geometric displacement $Q_{limit}$ (YES at step ST4), that is, in response to determining that the left available torque is insufficient, the controller 30 determines whether the required geometric displacement Q2* of the right main pump 14R is greater than the maximum allowable geometric displacement $Q_{limit}$ (step ST5). This is for determining whether part of a torque allocated to the right main pump 14R as a torque available to the right main pump 14R (hereinafter, "right available torque") may be re-allocated as a torque available to the left main pump 14L, before restricting the required geometric displacement Q1* by the maximum allowable geometric displacement $Q_{limit}$. That is, this is for determining whether part of the right available torque can be spared.

Therefore, in response to determining that the required geometric displacement Q2* is greater than the maximum allowable geometric displacement $Q_{limit}$ (YES at step ST5), that is, in response to determining that no part of the right available torque can be spared, the controller 30 sets the required geometric displacement Q1* to the maximum allowable geometric displacement $Q_{limit}$ and sets the required geometric displacement Q2* to the maximum allowable geometric displacement $Q_{limit}$ (step ST6). This is because the controller 30 cannot determine that the absorbed torque of the right main pump 14R is so small that part of the right available torque allocated to the right main pump 14R can be re-allocated as a torque available to the left main pump 14L.

In response to determining that the required geometric displacement Q2* is less than or equal to the maximum allowable geometric displacement Quit (NO at step ST5), that is, in response to determining that part of the right available torque can be spared, the controller 30 sets the required geometric displacement Q1* to the geometric displacement represented by Eq. (2) (step ST7). This is for re-allocating part of the right available torque allocated to the right main pump 14R as a torque available to the left main pump 14L.

$$Q1^* \leftarrow \frac{2 \times \pi \times T - P2 \times Q2}{P1} \tag{2}$$

In response to determining at step ST4 that the required geometric displacement Q1* is less than or equal to the maximum allowable geometric displacement Quit (NO at step ST4), that is, in response to determining that the left available torque is not insufficient, the controller 30 determines whether the required geometric displacement Q2* of the right main pump 14R is greater than the maximum allowable geometric displacement $Q_{limit}$ (step ST8). That is, the controller 30 determines whether the right available torque is excessive or insufficient relative to an absorbed torque necessary for achieving the required geometric displacement Q2* of the right main pump 14R.

Then, in response to determining that the required geometric displacement Q2* is greater than the maximum allowable geometric displacement $Q_{limit}$ (YES at step ST8), that is, in response to determining that the right available torque is insufficient, the controller 30 sets the required geometric displacement Q2* to the geometric displacement represented by Eq. (3) (step ST9). This is for re-allocating part of the left available torque allocated to the left main pump 14L as a torque available to the right main pump 14R.

$$Q2^* \leftarrow \frac{2 \times \pi \times T - P1 \times Q1}{P2} \tag{3}$$

In response to determining that the required geometric displacement Q2* is less than or equal to the maximum allowable geometric displacement $Q_{limit}$ (NO at step ST8), that is, in response to determining that both of the required geometric displacement Q1* and the required geometric displacement Q2* are less than or equal to the maximum allowable geometric displacement the controller 30 employs the required geometric displacement Q1* and the required geometric displacement Q2* as they are. This is because there is no need to re-allocate part of an available torque allocated to one of the left main pump 14L and the right main pump 14R as a torque available to the other.

Thereafter, the controller 30 outputs a command value based on the required geometric displacement Q1* to the left regulator 13L and outputs a command value based on the required geometric displacement Q2* to the right regulator 13R (step ST10).

According to this second setting process, the controller 30 can prevent a decrease in the rotational speed of the engine 11 due to the total absorbed torque of the main pump 14 exceeding the target torque T of the engine 11.

Furthermore, the controller 30 can re-allocate, as a torque available to the right main pump 14R, a torque that is allocated to the left main pump 14L as a torque available to the left main pump 14L but is not used by the left main pump 14L. Likewise, the controller 30 can re-allocate, as a torque available to the left main pump 14L, a torque that is allocated to the right main pump 14R as a torque available to the right main pump 14R but is not used by the right main pump 14R. Therefore, the controller 30 can more efficiently use the target torque T of the engine 11. For example, the controller 30 can prevent the geometric displacement of one of the left main pump 14L and the right main pump 14R from being excessively restricted although there is an engine torque to spare, that is, although the absorbed torque of the main pump 14 is sufficiently smaller than the target torque T.

Figure 4:
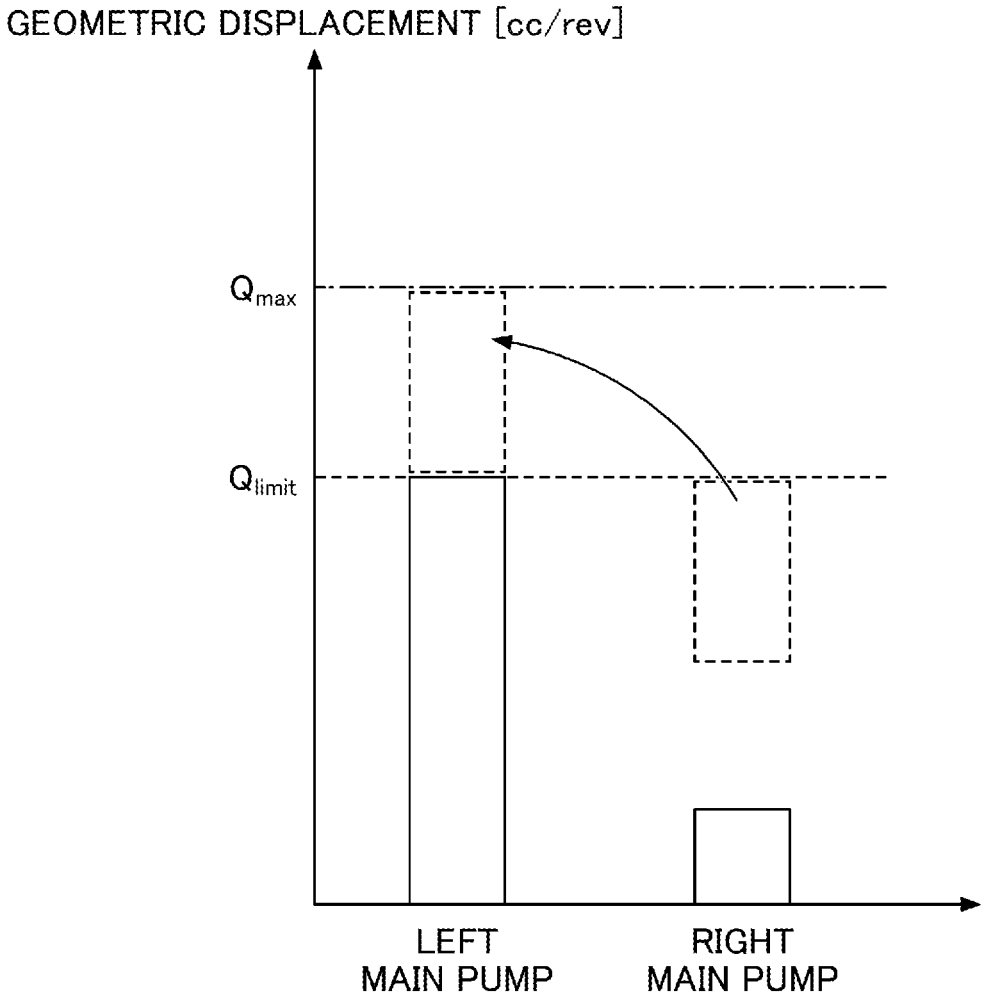
FIG. 4 is a bar chart illustrating the geometric displacement of a main pump.

Next, a specific example of the geometric displacement of the main pump 14 set by the second setting process is described with reference to FIG. 4. FIG. 4 is a bar chart illustrating an example setting of the geometric displacement of the main pump 14. Specifically, FIG. 4 illustrates values related to the geometric displacement of the main pump 14 when a complex operation of a boom raising operation and an arm closing operation is performed. More specifically, FIG. 4 illustrates values related to the geometric displacement of the main pump 14 when the operation of quickly closing the arm 5 with hydraulic oil discharged by the left main pump 14L while slowing raising the boom 4 with hydraulic oil discharged by the right main pump 14R is performed. The values related to the geometric displacement of the main pump 14 include the maximum allowable geometric displacement Quit and the maximum geometric displacement $Q_{max}$. The maximum allowable geometric displacement $Q_{limit}$ and the maximum geometric displacement $Q_{max}$ are values common to the left main pump 14L and the right main pump 14R. The maximum geometric displacement $Q_{max}$ is, for example, the maximum value of the geometric displacement determined by the mechanical restriction of the main pump 14.

According to the example of FIG. 4, the controller 30 obtains 577 [N·m] as the target torque T, obtains 20 [MPa] as the discharge pressure P1 of the left main pump 14L, and obtains 20 [MPa] as the discharge pressure P2 of the right main pump 14R. Therefore, the controller 30 calculates the maximum allowable geometric displacement $Q_{limit}$ at 90 [cc/rev], using Eq. (1). Furthermore, the controller 30 calculates the required geometric displacement Q1* of the left main pump 14L for extending the arm cylinder 8 at 110 [cc/rev] based on the output of the left control pressure sensor 19L and calculates the required geometric displacement Q2* of the right main pump 14R for extending the boom cylinder 7 at 20 [cc/rev] based on the output of the right control pressure sensor 19R. Furthermore, the maximum geometric displacement $Q_{max}$ is set at 130 [cc/rev]. Furthermore, the regions surrounded by a dashed line and the arrow in FIG. 4 indicate that part of the right available torque is re-allocated as a torque available to the left main pump 14L.

In this case, the controller 30 determines that the required geometric displacement Q1* (=110 [cc/rev]) is greater than the maximum allowable geometric displacement $Q_{limit}$ (=90 [cc/rev]), and determines that the required geometric displacement Q2* (=20 [cc/rev]) is less than the maximum allowable geometric displacement $Q_{limit}$ (=90 [cc/rev]). Therefore, the controller 30 sets the required geometric displacement Q1* of the left main pump 14L to the value calculated by Eq. (2).

Thereafter, the controller 30 outputs a command value based on the required geometric displacement Q1*, which is the value calculated by Eq. (2) to the left regulator 13L, and outputs a command value based on the required geometric displacement Q2* (=20 [cc/rev]) to the right regulator 13R.

As a result, the controller 30 can cause the left main pump 14L to discharge hydraulic oil with a geometric displacement greater than the maximum allowable geometric displacement $Q_{limit}$ (=90 [cc/rev]) to extend the arm cylinder 8 to quickly close the atm 5.

Furthermore, the controller 30 can cause the right main pump 14R to discharge hydraulic oil with the same geometric displacement Q2 (=20 [cc/rev]) as the initial required geometric displacement Q2* (=20 [cc/rev]) to extend the boom cylinder 7 to slowly raise the boom 4.

As described above, the shovel 100 according to an embodiment of the present invention includes the lower traveling structure 1, the upper swing structure 3 swingably mounted on the lower traveling structure 1, the engine 11 mounted on the upper swing structure 3, the left main pump 14L serving as a first hydraulic pump of an electrically controlled variable displacement type driven by the engine 11, the right main pump 14R serving as a second hydraulic pump of an electrically controlled variable displacement type driven by the engine 11, the left regulator 13L serving as a first regulator that controls the geometric displacement Q1 of the left main pump 14L, the right regulator 13R serving as a second regulator that controls the geometric displacement Q2 of the right main pump 14R, and the controller 30 serving as a control device that electrically controls the left regulator 13L and the right regulator 13R. The controller 30 is configured to calculate the maximum allowable geometric displacement $Q_{limit}$, which is the limit value of the geometric displacement of each of the left main pump 14L and the right main pump 14R, based on the discharge pressure P1 of the left main pump 14L and the discharge pressure P2 of the right main pump 14R, and to control the geometric displacement of each of the left main pump 14L and the right main pump 14R based on the calculated maximum allowable geometric displacement $Q_{limit}$.

According to this configuration, the shovel 100 can more appropriately control the geometric displacements of multiple variable displacement hydraulic pumps. Specifically, the shovel 100 can more appropriately control the geometric displacement of each of the electrically controlled left main pump 14L and right main pump 14R. Therefore, the shovel 100 can control or prevent a decrease in the rotational speed of the engine 11 due to the absorbed torque of the main pump 14 including the left main pump 14L and the right main pump 14R exceeding the target torque T of the engine 11.

The controller 30 may be configured to, when the required geometric displacement of one of the left main pump 14L and the right main pump 14R is less than the maximum allowable geometric displacement $Q_{limit}$ serving as the limit value, spare the other of the left main pump 14L and the right main pump 14R part (an excess) of an available torque allocated to the one of the left main pump 14L and the right main pump 14R. For example, when the required geometric displacement Q1* of the left main pump 14L is less than the maximum allowable geometric displacement $Q_{limit}$, the controller 30 may spare the right main pump 14R part (an excess) of the left available torque allocated to the left main pump 14L. When the required geometric displacement Q2* of the right main pump 14R is less than the maximum allowable geometric displacement $Q_{limit}$, the controller 30 may spare the left main pump 14L part (an excess) of the right available torque allocated to the right main pump 14R. According to this configuration, the controller 30 can more efficiently use the target torque T of the engine 11.

An embodiment of the present invention is described in detail above. The present invention, however, is not limited to the above-described embodiment. Various variations, substitutions, etc., may be applied to the above-described embodiment without departing from the scope of the present invention. Furthermore, the separately described features may be combined to the extent that no technical contradiction is caused.

For example, the hydraulic system installed in the shovel 100, which is configured to be able to execute negative control as energy saving control according to the above-described embodiment, may be configured to be able to execute positive control, load sensing control, or the like. In the case where positive control is adopted, the controller 30, for example, may be configured to calculate the required geometric displacement based on an operating pressure detected by the operating pressure sensor 29. Furthermore, in the case where load sensing control is adopted, the controller 30, for example, may be configured to calculate the required geometric displacement based on the output of a load pressure sensor (not depicted) that detects the pressure of hydraulic oil in an actuator and a discharge pressure detected by the discharge pressure sensor 28.

Furthermore, the controller 30, which executes the setting process when a complex operation of a boom raising operation and an arm closing operation is performed according to the above-described embodiment, may also execute the setting process when another complex operation such as a complex operation of a boom raising operation and a bucket closing operation is performed. Furthermore, the controller 30 may also execute the setting process when operations such as a boom raising operation, a boom lowering operation, an arm closing operation, an arm opening operation, a bucket closing operation, a bucket opening operation, a swing operation, and a traveling operation are independently performed.

Furthermore, according to the above-described embodiment, hydraulic operating levers including a hydraulic pilot circuit are disclosed. Specifically, in a hydraulic pilot circuit associated with the left operating lever 26L, hydraulic oil supplied from the pilot pump 15 to the left operating lever 26L is conveyed to a pilot port of the control valve 176 at a flow rate commensurate with the degree of opening of a remote control valve that is opened or closed by the tilt of the left operating lever 26L in the arm opening direction. In a hydraulic pilot circuit associated with the right operating lever 26R, hydraulic oil supplied from the pilot pump 15 to the right operating lever 26R is conveyed to a pilot port of the control valve 175 at a flow rate commensurate with the degree of opening of a remote control valve that is opened or closed by the tilt of the right operating lever 26R in the boom raising direction.

Instead of such hydraulic operating levers including a hydraulic pilot circuit, however, electric operating levers with an electric pilot circuit may be adopted. In this case, the amount of lever operation of an electric operating lever is input to the controller 30 as an electrical signal, for example. Furthermore, a solenoid valve is placed between the pilot pump 15 and a pilot port of each control valve. The solenoid valve is configured to operate in response to an electrical signal from the controller 30. According to this configuration, when a manual operation using the electric operating lever is performed, the controller 30 can move each control valve by increasing or decreasing a pilot pressure by controlling the solenoid valve in response to an electrical signal commensurate with the amount of lever operation.

What is claimed is:

1. A shovel comprising:

a lower traveling structure;

an upper swing structure swingably mounted on the lower traveling structure;

an engine mounted on the upper swing structure;

a first hydraulic pump configured to be driven by the engine, the first hydraulic pump being an electrically controlled variable displacement hydraulic pump;

a second hydraulic pump configured to be driven by the engine, the second hydraulic pump being an electrically controlled variable displacement hydraulic pump;

a first regulator configured to control a first geometric displacement of the first hydraulic pump;

a second regulator configured to control a second geometric displacement of the second hydraulic pump; and processing circuitry configured to electrically control the first and second regulators, wherein the processing circuitry is configured to calculate a limit value of the first and second geometric displacements based on respective discharge pressures of the first and second hydraulic pumps, calculate a first required geometric displacement of the first hydraulic pump and a second required geometric displacement of the second hydraulic pump, compare the first required geometric displacement with the limit value and compare the second required geometric displacement with the limit value, and spare the second hydraulic pump part of an available torque allocated to the first hydraulic pump in response to determining, as a result of said comparing, that the second required geometric displacement exceeds the limit value and the first required geometric displacement is less than the limit value.

2. The shovel as claimed in claim 1, wherein the processing circuitry is further configured to spare the first hydraulic pump part of an available torque allocated to the second hydraulic pump in response to determining, as a result of said comparing, that the first required geometric displacement of the first hydraulic pump is greater than the limit value and the second required geometric displacement is less than the limit value.

3. The shovel as claimed in claim 1, wherein the processing circuitry is configured to calculate the limit value based on an output of the engine.

4. The shovel as claimed in claim 1, wherein the processing circuitry is configured to restrict the first required geometric displacement to the limit value in response to determining, as a result of said comparing, that the first required geometric displacement exceeds the limit value.

5. The shovel as claimed in claim 1, wherein the processing circuitry is configured to control the first geometric displacement based on the first required geometric displacement in response to determining, as a result of said comparing, that the first required geometric displacement is less than the limit value.

6. The shovel as claimed in claim 1, wherein the processing circuitry is configured to allocate the first and second required geometric displacements to the first and second hydraulic pumps, respectively, in such a manner as to prevent a total torque of the first and second hydraulic pumps from exceeding a torque of the engine.

7. The shovel as claimed in claim 1, wherein the processing circuitry is configured to spare the first hydraulic pump an excess of an available torque allocated to the second hydraulic pump in response to determining, as a result of said comparing, that the first required geometric displacement exceeds the limit value and the second required geometric displacement is less than the limit value.

8. The shovel as claimed in claim 7, wherein the processing circuitry is further configured to spare the second hydraulic pump an excess of the available torque allocated to the first hydraulic pump in response to determining, as a result of said comparing, that the second required geometric displacement exceeds the limit value and the first required geometric displacement is less than the limit value.

9. The shovel as claimed in claim 1, wherein the processing circuitry is configured to restrict each of the first required geometric displacement and the second geometric displacement to the limit value in response to determining, as a result of said comparing, that the first required geometric displacement exceeds the limit value and the second required geometric displacement exceeds the limit value.

10. The shovel as claimed in claim 9, wherein the processing circuitry is further configured to control the first geometric displacement and the second geometric displacement based on the first required geometric displacement and the second required geometric displacement, respectively, in response to determining, as a result of said comparing, that the first required geometric displacement is less than the limit value and the second required geometric displacement is less than the limit value.

11. The shovel as claimed in claim 1, further comprising:

a first sensor configured to detect a first discharge pressure of the first hydraulic pump; and a second sensor configured to detect a second discharge pressure of the second hydraulic pump, wherein the processing circuitry is configured to calculate the limit value based on a sum of the first discharge pressure detected by the first sensor and the second discharge pressure detected by the second sensor.

* * * * *